US012018342B2

(12) United States Patent
Fu et al.

(10) Patent No.: US 12,018,342 B2
(45) Date of Patent: Jun. 25, 2024

(54) ROLLER QUENCHING FLOW ZONE CONTROL DEVICE FOR METAL PLATE STRIPS

(71) Applicant: Northeastern University, Liaoning (CN)

(72) Inventors: Tianliang Fu, Liaoning (CN); Xiangtao Deng, Liaoning (CN); Guodong Wang, Liaoning (CN); Zhifu Zhang, Liaoning (CN); Guanghao Liu, Liaoning (CN); Mingjun Zheng, Liaoning (CN); Guozhi Song, Liaoning (CN); Wei Cui, Liaoning (CN); Min Song, Liaoning (CN); Zhiwei Jia, Liaoning (CN)

(73) Assignee: NORTHEASTERN UNIVERSITY, Liaoning (CN)

( * ) Notice: Subject to any disclaimer, the term of this patent is extended or adjusted under 35 U.S.C. 154(b) by 656 days.

(21) Appl. No.: 17/276,781

(22) PCT Filed: Aug. 8, 2019

(86) PCT No.: PCT/CN2019/099732
§ 371 (c)(1),
(2) Date: Mar. 16, 2021

(87) PCT Pub. No.: WO2020/078080
PCT Pub. Date: Apr. 23, 2020

(65) Prior Publication Data

US 2022/0042121 A1 Feb. 10, 2022

(30) Foreign Application Priority Data

Oct. 19, 2018 (CN) ..... 201811218538.4

(51) Int. Cl.
*C21D 1/667* (2006.01)
*C21D 9/46* (2006.01)
(Continued)

(52) U.S. Cl.
CPC ..... *C21D 1/667* (2013.01); *C21D 9/46* (2013.01); *C21D 9/52* (2013.01); *C21D 11/00* (2013.01)

(58) Field of Classification Search
CPC . C21D 1/667; C21D 9/46; C21D 9/52; C21D 11/00
(Continued)

(56) References Cited

U.S. PATENT DOCUMENTS 3,420,083 A * 1/1969 Loveless ..... B21B 45/0218 72/364
3,546,911 A * 12/1970 Lenz ..... B21B 45/0218 72/201
(Continued)

FOREIGN PATENT DOCUMENTS

CN 103834791 * 6/2014 ..... C21D 9/46
CN 103834791 A 6/2014
(Continued)

*Primary Examiner* — Jessee R Roe
*Assistant Examiner* — Michael Aboagye
(74) *Attorney, Agent, or Firm* — MUNCY, GEISSLER, OLDS & LOWE, P.C.

(57) ABSTRACT

Heat treatment equipment for metal plate strips, and a roller quenching flow zone control device for metal plate strips. The device includes a middle water diversion ring sleeve and edge water diversion ring sleeves; the middle water diversion ring sleeve is installed at the middle processing groove in a slit nozzle rear spiral roller and a high-density nozzle rear spiral roller in a high-pressure cooling section of a roller quenching machine; and the edge water diversion ring sleeves are installed at the processing grooves in ¼ and ¾ positions in the width direction of the slit nozzle rear
(Continued)

spiral roller in the high-pressure cooling section of the roller quenching machine. This can effectively realize uniform distribution of cooling water on the surface of the plate strip, reduce the phenomenon of local non-uniform cooling caused by siltation of cooling water.

5 Claims, 1 Drawing Sheet

(51) Int. Cl.
*C21D 9/52* (2006.01)
*C21D 11/00* (2006.01)

(58) Field of Classification Search
USPC ..... 266/44, 46, 111, 113, 114, 259
See application file for complete search history.

(56) References Cited

U.S. PATENT DOCUMENTS 3,793,867 A * 2/1974 Safford ..... C21D 1/667
72/201
4,149,703 A * 4/1979 Safford ..... B21B 45/0233
134/199

FOREIGN PATENT DOCUMENTS

| | | | |
|---|---|---|---|
| CN | 107142362 | A | 9/2017 |
| CN | 108070693 | A | 5/2018 |
| CN | 108070699 | A | 5/2018 |
| CN | 108180816 | A | 6/2018 |
| CN | 108277339 | A | 7/2018 |
| CN | 109207689 | A | 1/2019 |
| JP | S63168215 | A | 7/1988 |

* cited by examiner (a) (b) (c)

ROLLER QUENCHING FLOW ZONE CONTROL DEVICE FOR METAL PLATE STRIPS

TECHNICAL FIELD

The present invention belongs to the technical field of heat treatment equipment for metal plate strips, and relates to a roller quenching flow zone control device for metal plate strips.

BACKGROUND

The heat treatment of metal plate strips involves processes such as normalizing, quenching, tempering, controlled cooling and solid solution, wherein the processes such as quenching, controlled cooling and solid solution need to heat the metal plate strip to a certain temperature (generally >800° C.) and then cool the metal plate strip to the final cooling temperature of the process by means of water cooling at a certain cooling rate to achieve the purposes of improving the internal structure of the metal and enhancing the performance.

The heat treatment of metal plate strips usually adopts a roller-hearth heat treatment furnace to complete the heating process, and adopts a roller quenching machine to complete quenching, controlled cooling and other processes. The roller quenching machine achieves strong cooling capacity, uniform cooling, and good plate shape of cooled pate strips, can be used for production such as quenching, solid solution and controlled cooling of carbon steel, stainless steel, special alloy, titanium alloy, aluminum alloy and other metal plate strips, and is the main form of cooling equipment for large heat treatment lines. The roll quenching machine adopts a jet impact quenching method, high-pressure and large-flow cooling water impacts the upper and lower surfaces of the plate strip at a high speed and pierces the vapor films on the surfaces to realize single-phase forced convection heat exchange directly with the wall surface, the heat exchange efficiency of the wall surface is high, and the heat exchange controllability is good.

The high-pressure cooling section of the roller quenching machine is the main process section for the temperature drop of metal plate strips, and has high cooling speed and high cooling uniformity requirements. During quenching, the water flow pattern on the wall surface determines the heat flux density distribution so as to determine the heat exchange uniformity of the surfaces and influence the plate shape and the performance distribution of quenched metal plate strips, and thus is a critical control parameter of the quenching process. The water flow pattern of the wall surface is mainly controlled by two methods: 1) controlling jet parameters such as water volume and water pressure by different types of jet nozzles and the arrangement design thereof; and 2) controlling the water flow pattern of the wall surface of the metal plate strip by means of external constraint by reasonably designing equipment parameters such as type of upper and lower roller beds, roll pitch and roll gap. For the second method, the current roller quenching machine generally adopts spiral rollers and uses spiral drainage grooves in the spiral rollers to rotate to different directions to adjust the water flow direction on the wall surface of the plate strip so as to quickly drain the residual cooling water surface on the wall surface of the plate strip.

The spiral roller system of the high-pressure cooling section of the existing roller quenching machine has the following problems: 1) to realize the rapid drainage of the residual cooling water on the surface of the metal plate strip to the edge, the spiral roller has opposite rotation directions on both sides of the centerline, a processing groove exists in the center of the spiral roller, and the longitudinal water flow of the metal plate strip at the processing groove is concentrated, which influences the water flow uniformity of the whole plate; 2) to enhance the drainage efficiency of the water from the slit nozzle of the high-pressure cooling section of the roller quenching machine, drainage grooves are designed in ¼ and ¾ positions in the width direction of the slit nozzle rear spiral roller, and influence the flow uniformity of the plate strip in the width direction, which causes the plate shape problems of the quenched plate strip. The above problems affect the flow uniformity in the length, width and thickness directions in the roller quenching process of the metal plate strip, thus affecting heat exchange and temperature drop and finally affecting the quenching plate shape and performance uniformity of the plate strip. Therefore, how to reasonably design a water diversion device of a spiral roller in a high-pressure cooling section of a roller quenching machine to realize the uniform and orderly distribution of the water flow during the quenching process of the plate strip in the length, width and thickness directions, improve the heat exchange uniformity, effectively and quickly remove the residual cooling water on the wall surface of the plate strip and enhance the heat exchange efficiency is one of the keys to realize high-uniformity and high-flatness quenching of metal plate strips.

The patent CN107142362A discloses a measuring device and method for measuring the flow uniformity in the width direction of a quenching machine, which measures the water flow density distribution of a nozzle in the width direction by a special water trough type measuring device. The main function of the device is to measure the flow uniformity in the width direction of a nozzle, which is irrelevant to the quenching flow zone control device of the roller quenching machine of the present invention.

The patent CN108277339A discloses a heat treatment quenching process control system of steel plates, comprising primary control on the quenching machine and secondary control on the quenching machine. The invention is an optimization system based on heat treatment quenching process control, which is irrelevant to the quenching flow zone control device of the roller quenching machine of the present invention.

The patent CN108180816A discloses a method for quickly measuring a slit nozzle of a quenching machine, which measures the jet angle of the slit nozzle and the jet point positions of the upper and lower nozzles by applying lubricant to the test device. The method is a measurement method used to improve the jet accuracy of the nozzle of the roller quenching machine, which is irrelevant to the quenching flow zone control device of the roller quenching machine of the present invention.

SUMMARY

The purpose of the present invention is to provide a roller quenching flow zone control device for metal plate strips, which can realize the uniform distribution of surface water flow during cooling of metal plate strips in the high-pressure cooling section of the roller quenching machine, realize the rapid drainage of residual cooling water, improve the cooling uniformity in the length, width and thickness directions of the roller quenching machine, and realize high-flatness and high-uniformity quenching.

A roller quenching flow zone control device for metal plate strips comprises a middle water diversion ring sleeve and edge water diversion ring sleeves; the middle water diversion ring sleeve is installed at the middle processing groove in a slit nozzle rear spiral roller and a high-density nozzle rear spiral roller in a high-pressure cooling section of a roller quenching machine; and the edge water diversion ring sleeves are installed at the processing grooves in ¼ and ¾ positions in the width direction of the slit nozzle rear spiral roller in the high-pressure cooling section of the roller quenching machine.

Wherein the middle water diversion ring sleeve comprises an upper left semicircular water diversion ring sleeve, a lower left semicircular water diversion ring sleeve, an upper right semicircular water diversion ring sleeve and a lower right semicircular water diversion ring sleeve, and the inner diameters of the four semicircular water diversion ring sleeves are consistent with the outer diameter of the middle processing groove in the slit nozzle rear spiral roller and the high-density nozzle rear spiral roller in the high-pressure cooling section of the roller quenching machine; the outer diameters of the four semicircular water diversion ring sleeves are consistent and smaller than the outer diameter of the spiral roller in the high-pressure cooling section of the roller quenching machine by 5 mm-10 mm, spiral drainage grooves are designed in the outer surfaces of the semicircular water diversion ring sleeves, the rotation direction of the spiral drainage grooves in the outer surfaces of the upper left semicircular water diversion ring sleeve and the lower left semicircular water diversion ring sleeve is consistent with that of the drainage groove in the left connected spiral roller, and the rotation direction of the spiral drainage grooves in the outer surfaces of the upper right semicircular water diversion ring sleeve and the lower right semicircular water diversion ring sleeve is consistent with that of the drainage groove in the right connected spiral roller; and the four semicircular water diversion ring sleeves are tightly connected and fixed according to the distribution positions to form the whole middle water diversion ring sleeve;

Each edge water diversion ring sleeve comprises an upper semicircular water diversion ring sleeve and a lower semicircular water diversion ring sleeve, and the inner diameters of the two semicircular water diversion ring sleeves are consistent with the outer diameters of the processing grooves in ¼ and ¾ positions in the width direction of the slit nozzle rear spiral roller in the high-pressure cooling section of the roller quenching machine; and the outer diameters of the two semicircular water diversion ring sleeves are consistent and smaller than the outer diameter of the spiral roller in the high-pressure cooling section of the roller quenching machine by 5 mm-10 mm, spiral drainage grooves are designed in the outer surfaces of the semicircular water diversion ring sleeves, and the rotation direction of the spiral drainage grooves is consistent with that of the drainage groove of the spiral roller connected therewith.

The spiral drainage grooves have depths of 6 mm-8 mm and widths of 20 mm-30 mm.

Further, the middle water diversion ring sleeve also comprises two connecting plates, bolt fixing holes are formed in the connecting plates and correspond to bolt counterbores in the outer surfaces of the Joints of the upper left and right semicircular water diversion ring sleeves and the lower left and right semicircular water diversion ring sleeves, and connecting plate mounting grooves are formed in the joints of the lower right and right semicircular water diversion ring sleeves and the lower left and right semicircular water diversion ring sleeves and have the same dimension as the connecting plates.

Further, the edge water diversion ring sleeve also comprises two connecting plates, bolt fixing holes are formed in the connecting plates and correspond to the bolt counterbores in the outer surface of the joint of the upper semicircular water diversion ring sleeve and the lower semicircular water diversion ring sleeve for convenience of installing fastening bolts, and connecting plate mounting groove are formed in the joint of the upper semicircular water diversion ring sleeve and the lower semicircular water diversion ring sleeve and have the same dimension as the connecting plates.

Further, no edge water diversion ring sleeve is installed in the ¼ and ¾ positions in the width direction of the high-density nozzle rear spiral roller in the high-pressure cooling section of the roller quenching machine.

The middle water diversion ring sleeve is installed at the middle processing groove in the slit nozzle rear spiral roller and the high-density nozzle rear spiral roller in the high-pressure cooling section of the roller quenching machine, which has the functions of water retaining, water diversion and water drainage, for convenience of the spiral roller in the high-pressure cooling section of the roller quenching machine to drain the cooling water in the middle parts of the slit nozzle and the high-density nozzle to both sides; the edge water diversion ring sleeves are installed at the processing grooves in the ¼ and ¾ positions in the width direction of the slit nozzle rear spiral roller in the high-pressure cooling section of the roller quenching machine, which has the functions of water retaining, water diversion and water drainage, for convenience of the spiral roller in the high-pressure cooling section of the roller quenching machine to drain the side cooling water of the slit nozzle to the edge of the metal plate strip; as the jet flow of the high-density nozzle in the high-pressure cooling section of the roller quenching machine is smaller than that of the slit nozzle, the phenomenon of disorderly water flow caused by siltation of residual water at the edge of the plate strip is not obvious, and no edge water diversion ring sleeve is installed in the ¼ and ¾ positions in the width direction of the high-density nozzle rear spiral roller in the high-pressure cooling section of the roller quenching machine.

Compared with the technical level of the existing equipment, the roller quenching flow zone control device for metal plate strips has the following advantages:

1. The middle water diversion ring sleeve can not only implement the function of uniform water diversion to both sides of the cooling water in the middle parts of the slit nozzle and the high-density nozzle in the high-pressure cooling section of the roller quenching machine, but also implement the function of drainage of the cooling water, which improves the cooling uniformity of the middle surface of the metal plate strip in the width direction and enhances the drainage efficiency so as to enhance the heat exchange efficiency.
2. The edge water diversion ring sleeves can effectively drain the cooling water in the ¼ and ¾ positions in the width direction of the slit nozzle in the high-pressure cooling section of the roller quenching machine to the edge of the plate strip in an orderly manner, thus preventing problems such as non-uniform cooling and decreased cooling efficiency caused by the accumulation of local residual cooling water; and has the function of partial water retaining, thus preventing the cooling water in the ¼ and ¾ positions in the width direction of the slit nozzle in the high-pressure cooling section of the roller quenching machine from flowing into the next cooling zone through the processing groove in the spiral roller and enhancing the heat exchange uniformity of the region.

3. The water diversion ring sleeves have the advantages of convenient disassembly and assembly, compact structure, long service life, and no damage to the surface quality of metal plate strips.

In the figures, 1 plate strip; 2. high-pressure cooling section of roller quenching machine; 3 slit nozzle; 4 slit nozzle rear spiral roller; 5 high-density nozzle; 6 high-density nozzle rear spiral roller; 7 middle water diversion ring sleeve; 8 edge water diversion ring sleeve; 9 upper left semicircular water diversion ring sleeve; 10 upper right semicircular water diversion ring sleeve; 11 mounting groove; 12 connecting plate; 13 bolt fixing hole; 14 bolt counterbore; 15 lower left semicircular water diversion ring sleeve; 16 lower right semicircular water diversion ring sleeve; 17 fastening bolt; 18 upper semicircular water diversion ring sleeve; 19 lower semicircular water diversion ring sleeve; 20 middle processing groove; and 21 spiral drainage groove.

DETAILED DESCRIPTION

Figure 1:
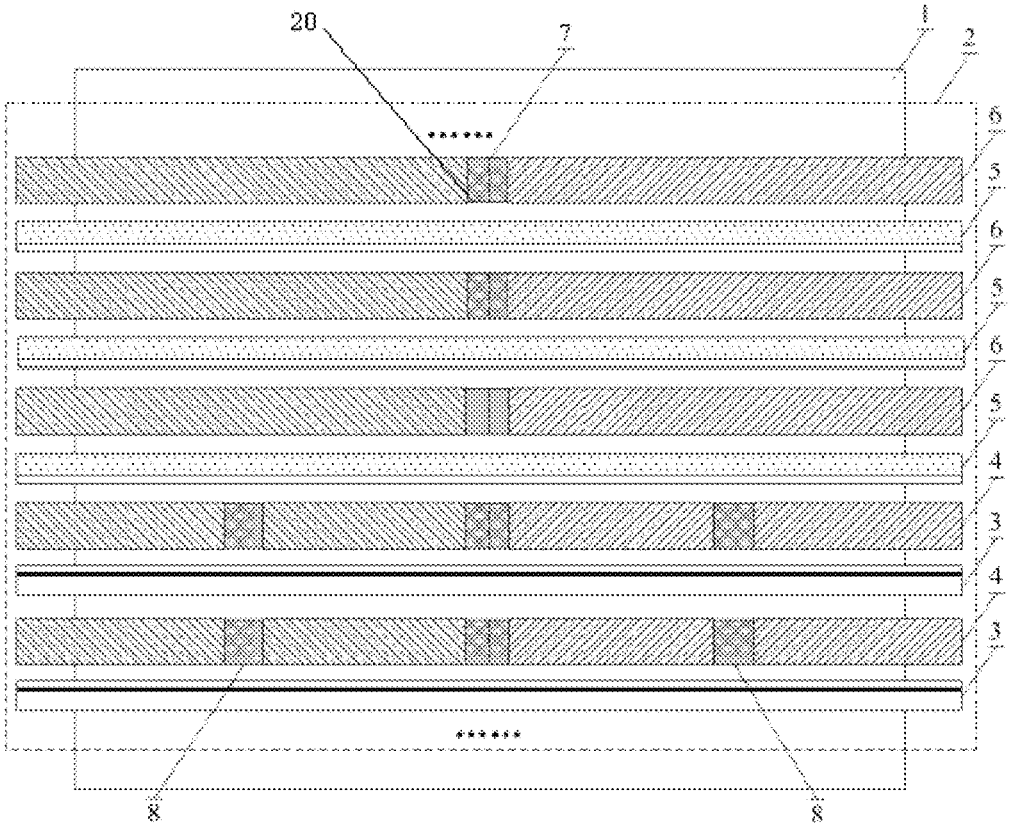
FIG. 1 is an arrangement diagram of a roller quenching flow zone control device for metal plate strips in the present invention.

Embodiment 1 provides the concrete implementation process of a roller quenching flow zone control device for metal plate strips of the present invention, as shown in FIG. 1. The plate strip 1 passes through the slit nozzle 3, the slit nozzle rear spiral roller 4, the high-density nozzle 5 and the high-density nozzle rear spiral roller 6 in sequence after entering the high-pressure cooling section 2 of the roller quenching machine. When the plate strip 1 passes through the slit nozzle rear spiral roller 4, the jet cooling water in the middle part of the slit nozzle 3 passes through the middle water diversion ring sleeve 7 of the slit nozzle rear spiral roller 4 and then is diverted to both sides in an orderly manner, which prevents the siltation of cooling water in the middle part of the plate strip 1 in the width direction and realizes orderly and uniform drainage of the cooling water to both sides; and the cooling water near the ¼ and ¾ positions in the width direction of the slit nozzle 3 passes through the edge water diversion ring sleeves 8 of the slit nozzle rear spiral roller 4 and then is diverted to both sides of the plate strip 1 in the width direction in an orderly manner, which prevents the siltation of cooling water near the ¼ and ¾ positions in the width direction of the plate strip 1 and realizes orderly and uniform drainage of the cooling water to left and right sides. When the plate strip 1 passes through the high-density nozzle rear spiral roller 6, the jet cooling water in the middle part of the high-density nozzle 5 passes through the middle water diversion ring sleeve 7 of the high-density nozzle rear spiral roller 6 and then is diverted to both sides in an orderly manner, which prevents the siltation of cooling water in the middle part of the plate strip 1 in the width direction and realizes orderly and uniform drainage of the cooling water to both sides; and as the jet cooling water volume of the high-density nozzle 5 is less than that of the slit nozzle 3, the siltation of the cooling water near the ¼ and ¾ positions in the width direction of the plate strip 1 has little impact on the non-uniform cooling of the surface of the plate strip 1, and no edge water diversion ring sleeve 8 is designed in the ¼ and ¾ positions in the width direction of the high-density nozzle rear spiral roller 6. When the tail of the plate strip 1 leaves the high-pressure cooling section 2 of the roller quenching machine, the concrete implementation process of the roller quenching flow zone control device for plate strip ends.

Figure 2:
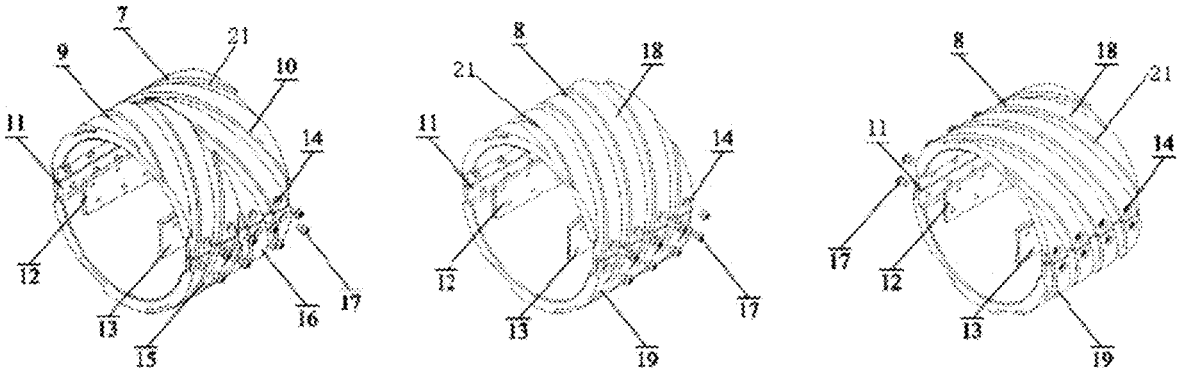
FIG. 2 is a diagram showing the shape and structure of a roller quenching flow zone control device for metal plate strips in the present invention; (a) middle water diversion ring sleeve, (b) edge water diversion ring sleeve on one side, (c) edge water diversion ring sleeve on the other side.

Embodiment 2 provides the concrete installation process of a roller quenching flow zone control device for metal plate strips of the present invention, as shown in FIG. 1 and FIG. 2. The middle water diversion ring sleeve 7 is installed at the middle processing groove in the slit nozzle rear spiral roller 4 or the high-density nozzle rear spiral roller 6 in the high-pressure cooling section 2 of the roller quenching machine. During installation, first, the upper left semicircular water diversion ring sleeve 9 and the upper right semicircular water diversion ring sleeve 10 are aligned and placed at the middle processing groove of the slit nozzle rear spiral roller 4 or the high-density nozzle rear spiral roller 6 in the high-pressure cooling section 2 of the roller quenching machine, two connecting plates 12 are respectively placed in the mounting grooves 11 in the joints on both sides, and bolt fixing holes 13 in the connecting plates 12 correspond to bolt counterbores 14 in the outer surfaces of the upper left semicircular water diversion ring sleeve 9 and the upper right semicircular water diversion ring sleeve 10; then the lower left semicircular water diversion ring sleeve 15 and the lower right semicircular water diversion ring sleeve 16 are aligned and placed at the middle processing groove of the slit nozzle rear spiral roller 4 or the high-density nozzle rear spiral roller 6 in the high-pressure cooling section 2 of the roller quenching machine, and two connecting plates 12 are respectively placed in the mounting grooves 11 in the joints on both sides; and finally, fastening bolts 17 are respectively inserted into the bolt counterbores 14 in the outer surfaces, and the connecting plates 12 are fixed in the mounting grooves 11 in the joints of the upper left semicircular water diversion ring sleeve 9, the upper right semicircular water diversion ring sleeve 10, the lower left semicircular water diversion ring sleeve 15 and the lower right semicircular water diversion ring sleeve 16. The edge water diversion ring sleeves 8 are installed at the middle processing groove in the ¼ or ¾ position in the width direction of the slit nozzle rear spiral roller 4 in the high-pressure cooling section 2 of the roller quenching machine. During installation, first, the upper semicircular water diversion ring sleeve 18 is placed at the processing groove in the ¼ or ¾ position in the width direction of the slit nozzle rear spiral roller 4 in the high-pressure cooling section 2 of the roller quenching machine, two connecting plates 12 are respectively placed in the mounting grooves 11 in the joints on both sides, and bolt fixing holes 13 in the connecting plates 12 correspond to bolt counterbores 14 in the outer surface of the upper semicircular water diversion ring sleeve 18; then the lower semicircular water diversion ring sleeve 19 is placed at the processing groove in the ¼ or ¾ position in the width direction of the slit nozzle rear spiral roller 4 in the high-pressure cooling section 2 of the roller quenching machine, and two connecting plates 12 are respectively placed in the mounting grooves 11 in the joints on both sides; and finally, fastening bolts 17 are respectively inserted into the bolt counterbores 14 in the outer surface, and the connecting plates 12 are fixed in the mounting grooves 11 in the joint of the upper semicircular water diversion ring sleeve 18 and the lower semicircular water diversion ring sleeve 19. At this point, the concrete installation process of the roller quenching flow zone control device for metal plate strips ends.

The invention claimed is:

1. A roller quenching flow zone control device for metal plate strips, wherein a metal plate strip enters a slit nozzle, a slit nozzle rear spiral roller, a high-density nozzle and a high-density nozzle rear spiral roller in a high-pressure cooling section of a roller quenching machine in sequence; the control device comprises a middle water diversion ring sleeve and edge water diversion ring sleeves; the middle water diversion ring sleeve is installed at a middle processing groove in the slit nozzle rear spiral roller and the high-density nozzle rear spiral roller in the high-pressure cooling section of the roller quenching machine; and the edge water diversion ring sleeves are installed at edge processing grooves in ¼ and ¾ positions in a width direction of the slit nozzle rear spiral roller in the high-pressure cooling section of the roller quenching machine;

wherein the middle water diversion ring sleeve comprises an upper left semicircular water diversion ring sleeve, a lower left semicircular water diversion ring sleeve, an upper right semicircular water diversion ring sleeve and a lower right semicircular water diversion ring sleeve, and inner diameters of the four semicircular water diversion ring sleeves are equal to an outer diameter of the middle processing groove; outer diameters of the four semicircular water diversion ring sleeves are equal and smaller than an outer diameter of the spiral roller in the high-pressure cooling section of the roller quenching machine by 5 mm-10 mm, spiral drainage grooves are designed in outer surfaces of the semicircular water diversion ring sleeves, a rotation direction of the spiral drainage grooves in the outer surfaces of the upper left semicircular water diversion ring sleeve and a rotation direction of the spiral drainage grooves in the outer surfaces of the lower left semicircular water diversion ring sleeve are equal to a rotation direction of the drainage groove in a left connected spiral roller, and a rotation direction of the spiral drainage grooves in the outer surfaces of the upper right semicircular water diversion ring sleeve and a rotation direction of the spiral drainage grooves in the outer surfaces of the lower right semicircular water diversion ring sleeve are equal to a rotation of the drainage groove in a right connected spiral roller; and the four semicircular water diversion ring sleeves are tightly connected and fixed according to distribution positions to form the entire middle water diversion ring sleeve;

each edge water diversion ring sleeve comprises an upper semicircular water diversion ring sleeve and a lower semicircular water diversion ring sleeve, and inner diameters of two semicircular water diversion ring sleeves are equal to outer diameters of the edge processing grooves and outer diameters of the two semicircular water diversion ring sleeves are equal and smaller than the outer diameter of the spiral roller in the high-pressure cooling section of the roller quenching machine by 5 mm-10 mm, spiral drainage grooves are designed in the outer surfaces of the semicircular water diversion ring sleeves, and a rotation direction of the spiral drainage grooves in the outer surfaces of each edge water diversion ring sleeve is equal to a rotation of the drainage groove of the spiral roller connected therewith.

2. The roller quenching flow zone control device for metal plate strips according to claim 1, wherein the spiral drainage grooves have depths of 6 mm-8 mm and widths of 20 mm-30 mm.

3. The roller quenching flow zone control device for metal plate strips according to claim 1, wherein the middle water diversion ring sleeve also comprises two connecting plates, bolt fixing holes are formed in the connecting plates and correspond to bolt counterbores in the outer surfaces of the joints of the upper left and right semicircular water diversion ring sleeves and the lower left and right semicircular water diversion ring sleeves, and connecting plate mounting grooves are formed in the joints of the upper left and right semicircular water diversion ring sleeves and the lower left and right semicircular water diversion ring sleeves and have the same dimension as the connecting plates.

4. The roller quenching flow zone control device for metal plate strips according to claim 1, wherein each edge water diversion ring sleeve also comprises two connecting plates, bolt fixing holes are formed in the connecting plates and correspond to the bolt counterbores in the outer surface of a joint of the upper semicircular water diversion ring sleeve and the lower semicircular water diversion ring sleeve, and connecting plate mounting grooves are formed in the joint of the upper semicircular water diversion ring sleeve and the lower semicircular water diversion ring sleeve and have the same dimension as the connecting plates.

5. The roller quenching flow zone control device for metal plate strips according to claim 1, wherein no edge water diversion ring sleeve is installed in the ¼ and ¾ positions in the width direction of the high-density nozzle rear spiral roller in the high-pressure cooling section of the roller quenching machine.

* * * * *